United States Patent [19]

Sikes, Jr. et al.

[11] 3,999,038

[45] Dec. 21, 1976

[54] FLARED FUSER ROLL

[75] Inventors: Malcolm W. Sikes, Jr., Webster; Sudarshan S. Bains, Rochester; Paul D. Norder, Fairport; Jeffery L. Sisson, Macedon, all of N.Y.

[73] Assignee: Xerox Corporation, Stamford, Conn.

[22] Filed: Aug. 27, 1975

[21] Appl. No.: 608,122

Related U.S. Application Data

[63] Continuation of Ser. No. 526,768, Nov. 25, 1974, abandoned.

[52] U.S. Cl. ..... 432/60; 29/122; 100/93 RP; 219/216

[51] Int. Cl.[2] ..... F27B 9/28

[58] Field of Search ..... 219/216, 388, 469–471; 432/60, 228; 29/122; 100/93 RP

[56] References Cited

UNITED STATES PATENTS 3,884,623 5/1975 Slack ..... 432/60

*Primary Examiner*—C. L. Albritton

[57] ABSTRACT

An improved pressure heated fusing apparatus for a copier/duplicator machine capable of simplex and duplex operation wherein the copy sheets make two passes through processing stations including a first roll which is heated to a temperature sufficient to fuse toner images onto paper support sheet material and a second roll made of an elastic material arranged axially parallel with said first roll to define a nip through which the paper support sheet material bearing toner images is passed having a longitudinal cross-sectional shape with a maximum diameter at the ends and a minimum diameter at the center.

5 Claims, 3 Drawing Figures

FLARED FUSER ROLL

This is a continuation of application Ser. No. 526,768, filed Nov. 25, 1974, now abandoned.

This invention relates to improved flared fuser roll apparatus for fusing simplex and duplex copies produced from a high speed copier/duplicator.

In copier/duplicator systems producing copies wrinkled copies predominently occuring on the second pass of the duplexed copy through the pressure heated fusers have been a noticeable problem. The magnitude and frequency of the wrinkle are known to be a function of how long the copies are aged between simplex and duplex passes, and are definitely affected by aging in a high humidity environment. Normally, the paper wrinkle occurs when the sheet of paper has become distorted before being processed on the second pass by the machine so that it is no longer in a flat state. This is normally a result of elongation of the edges of the copy sheet due to absorbtion of moisture during the aging time between the simplex and duplex passes. During the first pass, the entire sheet is dried out, and because the copy sheet is part of a stack, moisture re-absorbtion takes place primarily through the edges. With the edges of the copy sheet being longer than the center, wrinkles are formed as the copy sheet goes through the roll nip during the duplex pass. It is also possible to produce wrinkled copy on the first pass if the paper is unpacked long enought prior to processing to permit it to absorb sufficient moisture to result in edge elongation.

It is therefore a general object of this invention to improve the quality of copy sheets produced by a copier/duplicator.

It is another object of this invention to minimize copy sheet wrinkle from a copier/duplicator capable of producing simplex and duplex copies.

It is still a further object of the invention to enable copier/duplicator simplex and duplex modes of operation without a loss of copy quality.

It is still a further object of the invention to improve fusing of copy sheets produced by high speed copier/duplicators making simplex and duplex copies.

It is still a further object of the invention to minimize the effect of edge elongation of paper passing through pressure heated fuser rolls in simplex and duplex sorting modes of operation.

The above and added advantages of the present invention will be more apparent after reading the following detailed description which refers to accompanying drawings in which.

Figure 1:
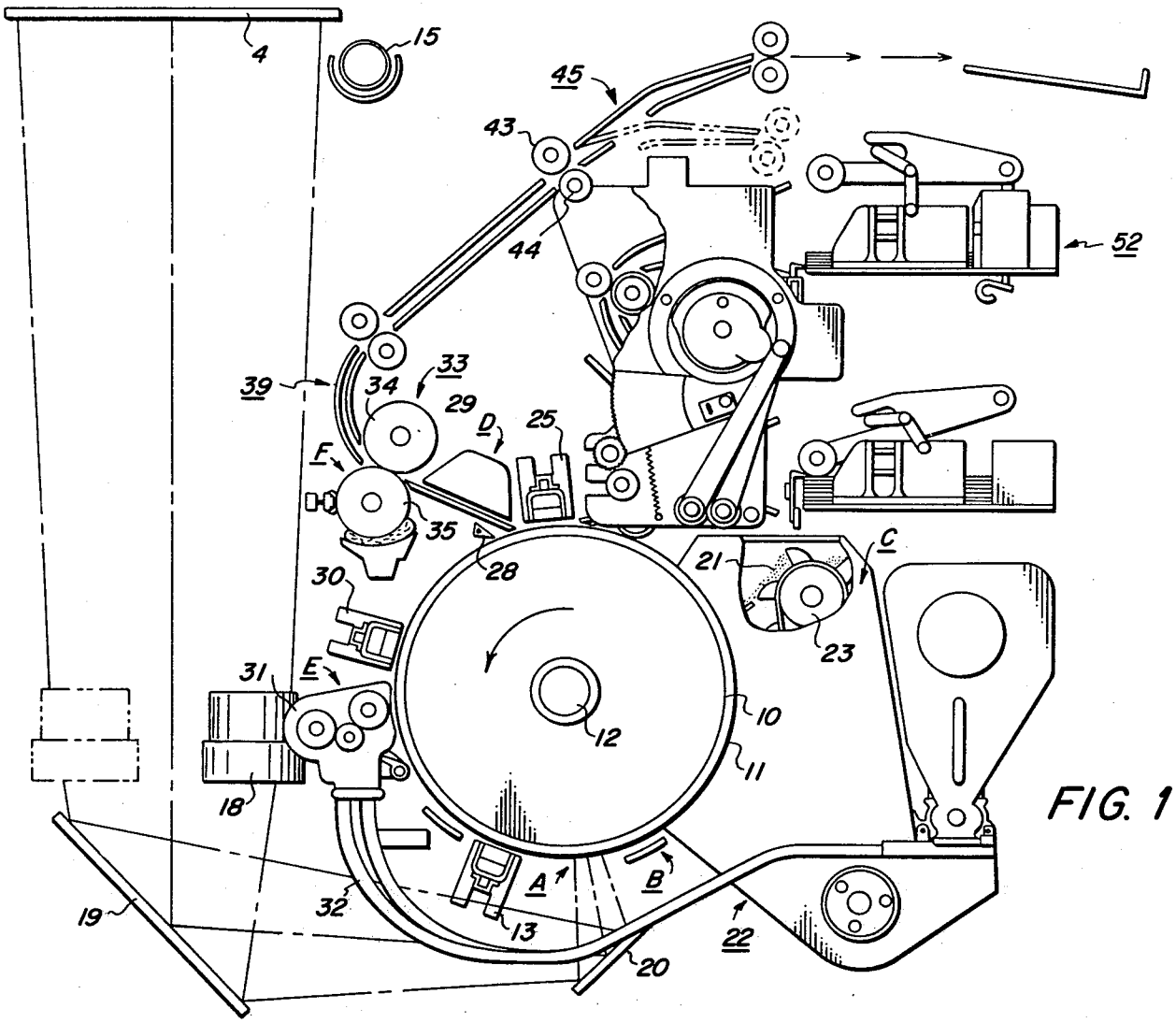
FIG. 1 is a schematic view of a xerographic copier/duplicator machine producing simplex and duplex copies according to the present invention.

FIG. 1 shows a schematic of the copier/duplicator system generally designated 2 including a copier machine 3, which is a high speed copier/duplicator capable of producing simplex or duplex copies at the option of a machine operator. The copier machine 3 has a platen 4 for receiving documents to be reproduced, and a control panel (not shown) which includes various control knobs, buttons and switches for selecting various modes of operation such as simplex and duplex copies and the number of copies to be reproduced.

The copier/duplicator system includes an automatic xerographic apparatus which includes a photosensitive plate including a photoconductive layer 10 that is placed over a conductive backing. The plate is formed in the shape of a drum 11 and the drum mounted upon a shaft 12 that is journaled for rotation in the machine frame. Basically, the xerographic drum is rotated in the direction indicated so as to pass sequentially through a series of xerographic processing stations. The photosensitive drum and the xerographic processing apparatus are driven at predetermined speeds relative to each other from a drive system (not shown) and the operation thereof coordinated in order to produce proper cooperation of the various processing mechanisms.

The original, to be reproduced, is placed upon a transparent horizontally supported platen 4 and the original scanned by means of a moving optical scanning system and to produce a flowing light image of the original. The scanning system includes an elongated horizontal extended aperture lamp 15 and a moveable lens element 18.

The lamp and lens element moves in coordination across the object supported upon the platen to focus successive incremental bans of illumination reflected from the object onto the moving drum surface at synchronous speeds therewith. The optical path is folded by means of a pair of image mirrors 19 and 20 interposed between the lens and the drum surface, the drum is first uniformly charged by means of a corona generator 13 positioned on charging station A. Under the influence of the flowing light image, the uniformly charged photoconductive surface is selectively dissipated in the non-image areas to form what is commonly known as a "latent electrostatic image".

The latent electrostatic image is carried on the drum surface from the exposure station into the developing station C. The developing station is primarily comprised of a developer housing 22 adapted to support a supply of two-component developer material 21 therein. The developer material is transported by means of a bucket system 23 from the bottom of the developer housing to an elevated position where the material is delivered into the active development zone. The developer material is caused to flow downwardly in contact with the upwardly moving drum surface under closely controlled conditions wherein charged toner particles are attracted from the developer mix into the image areas on the plate surface and thus making the image visible.

The moving drum surface next transports the developed xerographic image to a transfer station D. Cut sheets of final support material are also moved into the transfer station, the backside of the copy sheet is sprayed with an ion discharge from a transfer corotron 25 inducing on the sheet a charge having a polarity and magnitude sufficient to attract the toner material from the drum surface to the final support material. This induced charge also electrostatically tacks the final support material to the drum surface. In order to remove the copy sheet from the drum surface a stripper finger 28 is positioned downstream from the transfer coroton. The finger is arranged to move between the drum surface and the copy sheet and lifts the sheet from the drum surface and the copy sheet is directed along a predetermined path of travel into contact with a stationary vacuum transport 29.

Although a preponderance of the toner material is transferred from the drum surface to the copy sheet during the transfer process, invariably some residual toner remains behind on the drum surface after transfer. This residual toner is transported on the drum surface into a cleaning station E where it is brought under the influence of a cleaning corotron 30 adapted to neutralize the electrostatic charge tending to hold the residual toner to the drum surface. The neutralized toner is mechanically cleaned from the drum surface by means of a brush or the like and the toner collected within a housing 31. A conveyor moving in an endless loop through tubes 32 transports the collected residual toner back to the developer housing where it is deposited within the developer mix so that it can be once again reused in the xerographic developing process.

The copy sheet, which has been removed from the drum surface after the transfer operation is moved along stationary transport 29 into fusing station F. The fuser 33 is basically made up of an upper roll 34 and a lower fuser roll 35 mounted in operative relation to each other and the pressure driving contact therebetween. The upper roll 34 has a metal core surrounded by a cylinder of silicone rubber. The lower roll which is heated is a metal cylinder having a coating made of polytetrafluorethylene as described, for example, in U.S. Pat. No. 3,834,861. The lower roll is wiped with silicone oil to prevent image offset. As the heated roll is rotated in the direction indicated the heated surface of the lower roll is pressed into intimate contact with the image face of the copy sheet. Mechanical and heat energy are transported from the roll surface to the copy sheet to permanently bond the toner particles to the support material while minimizing the effect of edge elongation of the copy sheet passing through the rolls as will be explained more fully hereinafter.

Upon leaving the fuser, the fixed copy sheet is passed through a curvalinear sheet guide system, generally referred to as 39, into cooperating advancing rolls 43 and 44. At this point, depending on the mode of operation selected, the copy sheet is either forwarded directly to the output tray 105 or into the upper supply tray 52 by means of a movable sheet guide 45 for return through the processing stations to produce duplex copies.

It is believed that the foregoing description is sufficient for purposes of the present application to show the general operation of a xerographic reproducing machine. For a more detailed explanation of the copier/duplicator xerographic components reference is made to U.S. Pat. No. 3,645,615 entitled Copying Apparatus.

Figure 2:
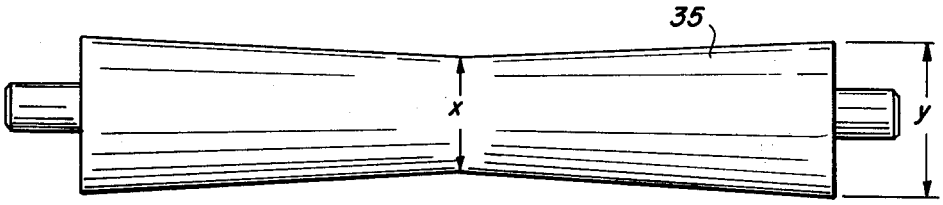
FIG. 2 is a side view of the improved roll apparatus according to the present invention.
Figure 3:
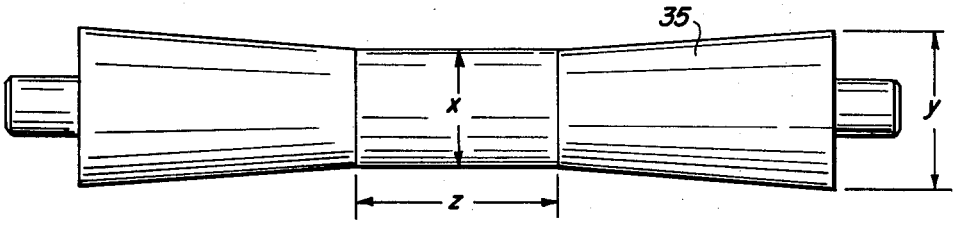
FIG. 3 is a side view of an alternate roll according to the invention.

Referring now to FIGS. 2 and 3 there is shown the improved lower heated roll 35 according to the present invention. It will be noted that the roll of FIG. 2 is flared or hourglass shaped with a single taper extending from the center diameter $x$ to the end diameter $y$. FIG. 3 shows an alternative embodiment having a double taper extending from a flat section z at the central portion of the roll. With the improved roll 35 of the invention it has been found that diameter differences between $x$ and $y$ desirably range from about 0.008 to about 0.024 inches and preferably between 0.016 to about 0.020 inches for copy sheet lengths extending from 11 to 14 inches. Smaller differences in the roll diameters will not correct the wrinkle problem whereas too great a difference can result in sheet distortion or curl. Also in the embodiment of FIG. 3 it has been found that section lengths z ranging from about 4 to about 8 inches work well with this paper length. The embodiment of FIG. 3 is preferred because of the tendency of the flared configuration FIG. 2 to drive the edges of the paper faster than the center which can cause a distortion problem if the humidity is not particularly high or the simplex mode of operation is used and edge elongation of the copy sheet minimal.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. An improved pressure heated fusing apparatus for a copier/duplicator machine capable of simplex and duplex operation wherein the copy sheets make two passes through processing station comprising:

a first roll which is heated to a temperature sufficient to fuse toner images onto paper support sheet material, a second roll arranged axially parallel with said first roll to define a nip through which the paper support sheet material bearing toner images is passed, said first roll having a longitudinal cross-sectional shape with a maximum diameter of the ends and a minimum diameter at the center and the difference of the diameters ranging from about 0.008 to about 0.024 inches for a sheet nip length extending from about 11 to about 14 inches, said first roll being formed with a taper at each end and having a center portion between the tapered ends of substantially uniform diameter.

2. Apparatus according to claim 1 wherein said first roll is relatively hard and is coated with silicone oil.

3. Apparatus according to claim 2 wherein said second roll includes a hard metal core covered with silicone rubber.

4. Apparatus according to claim 1 wherein said center portion extends from about 4 to about 8 inches for copy sheet nip lengths extending from 11 to 14 inches.

5. An improved pressure heated fusing apparatus for a copier/duplicator machine capable of simplex and duplex operation wherein the copy sheets make two passes through processing station comprising:

a first roll which is heated to a temperature sufficient to fuse toner images onto paper support sheet material, a second roll arranged axially parallel with said first material bearing toner images is passed, said first roll having a longitudinal cross-sectional shape with a maximum diameter at the ends and a minimum diameter at the center, said first roll being formed with a taper at each end and having a center portion extending longitudinally for a predetermined distance between the tapered ends of substantially uniform diameter.

* * * * *